United States Patent [19]

Matsumoto

[11] Patent Number: 4,685,798

[45] Date of Patent: Aug. 11, 1987

[54] CLEANER FOR AN ELECTROPHOTOGRAPHIC COPYING MACHINE

[75] Inventor: Kouichi Matsumoto, Gojyo, Japan

[73] Assignee: Sharp Kabushiki Kaisha, Osaka, Japan

[21] Appl. No.: 772,418

[22] Filed: Sep. 4, 1985

[30] Foreign Application Priority Data

Sep. 6, 1984 [JP] Japan ..... 59-136002[U]

[51] Int. Cl.[4] ..... G03G 21/00

[52] U.S. Cl. ..... 355/15; 15/256.51

[58] Field of Search ..... 355/15, 3 R; 15/1.5 R, 15/256.5, 256.51, 256.52

[56] References Cited

U.S. PATENT DOCUMENTS 4,530,594 7/1985 Adachi ..... 355/15

FOREIGN PATENT DOCUMENTS 57-130079 8/1982 Japan ..... 355/15

*Primary Examiner*—Fred L. Braun

*Attorney, Agent, or Firm*—Birch, Stewart, Kolasch & Birch

[57] ABSTRACT

A cleaner unit for an electrophotographic copying machine including a scraper blade in contact with the surface of a photoreceptive drum and a container for storing toner stripped from the surface of the photoreceptive drum by the scraper blade. The configuration of the cleaner includes an aperture in the container provided in a position above the bottom surface of the cleaner unit, a conveyer member which is provided inside the cleaner unit and is capable of reciprocating between the aperture of the container and an inlet aperture of the cleaner unit adjacent the photoreceptive drum and a guide plate that causes the conveyer member to move its tip into contact with the bottom surface of the cleaner unit when the conveyer member moves in the direction of the aperture of the container, and conversely, it prevents the tip end of the conveyer member from coming into contact with the bottom surface of the cleaner unit when the conveyer member moves in the direction of the inlet aperture adjacent the photoreceptive drum.

5 Claims, 6 Drawing Figures

CLEANER FOR AN ELECTROPHOTOGRAPHIC COPYING MACHINE

BACKGROUND OF THE INVENTION

The present invention relates to a cleaner for an electrophotographic copying machine generating pictures using toner, which is capable of removing residual toner from the surface of the photoreceptor following the discharge procedure.

Conventional copying machines which generate pictures using toner let the toner-absorbing photoreceptor continuously perform all photocopying operations. In other words, the surface of the photoreceptor that passes through the copying steps of "charge, light exposure, development, transfer, and discharge" is recharged and completes these steps again before performing the next copying operation. In the developing process, the toner absorbed by the surface of the photoreceptor is not fully transferred onto the papers being copied and part of the toner remains on the surface of the photoreceptor. If the next copying operation is executed using a photoreceptor containing residual toner, the toner tends to adhere to a portion of the copied paper other than the picture, thus making it difficult for the copy machine to correctly and cleanly complete the necessary copying operation. In order to accurately copy the original continuously, it is necessary to completely remove residual toner from the discharge-completed portion of the photoreceptor surface. Conventional electrophotographic copying machines include a cleaner with a blade made of elastic material which scrapes the residual toner from the surface of the photoreceptor between the discharge-charger and the charger-charger. The flecks of toner then traverse a screw shaft into a container mounted between the front cabinet and the front frame where a limited quantity of dislodged toner is stored until cleaning. Some conventional copying machines also provides a container below the cleaning unit which catches toner scraped by the blade. Such conventional cleaning methods require removal of the container when extracting clogged paper from the unit. Even when using an electrophotographic copier which integrates various copying machinery into one unit that can be easily attached or detached from the copying machine, it is necessary to remove the toner collection container to service the unit properly. The capacity of the toner collection container is limited by the confined space between the front cabinet and the front frame on standard copiers. Even when using the advanced integrated copying mechanism mentioned above, the capacity of the toner collection container is also limited due to space constraints. Consequently, when copying a large number of papers, even before general maintenance is required, residual toner may build up inside the container, inconveniencing clients who are forced to replace the stained container.

SUMMARY OF THE INVENTION

In the light of the disadvantages of conventional copying machines, the present invention aims at providing a useful cleaner for electrophotographic copying machines capable of relieving clients of the chore of replacing the toner container. This invention will serve the user by implementing the installation of a toner collection container in a specific position where the container capacity is not restricted. The present invention will make transfer or removal of the container unnecessary when copy paper jams the paper-feed path or while servicing other copying parts. In addition by increasing the storage capacity of the toner collection container itself, regularly scheduled maintenance will provide sufficient opportunity to empty or replace the full container. Other objects and further scope of applicability of the present invention will become apparent from the detailed description given hereinafter. It should be understood, however, that the detailed description of and specific examples, while indicating preferred embodiments of the invention, are given by way of illustration only, since various changes and modifications within the spirit and scope of the invention will become apparent to those skilled in the art from this detailed description.

In brief, the present invention provides a cleaner unit for an electrophotographic copying machine in which the aperture of the toner collection container rests at a position above the bottom surface of the cleaner. A conveyer piece is installed inside the cleaner unit, between said container aperture and the aperture of the cleaning unit adjacent the photoreceptor. A guide plate brings the tip of the conveyer member into contact with the bottom of the cleaner unit when the conveyer member moves in the direction of the aperture of the toner collection container and conversely prevents the tip of the conveyer member from coming into contact with the bottom of the cleaner unit when the conveyer member moves in the direction of the photoreceptor aperture.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE INVENTION

Figure 1:
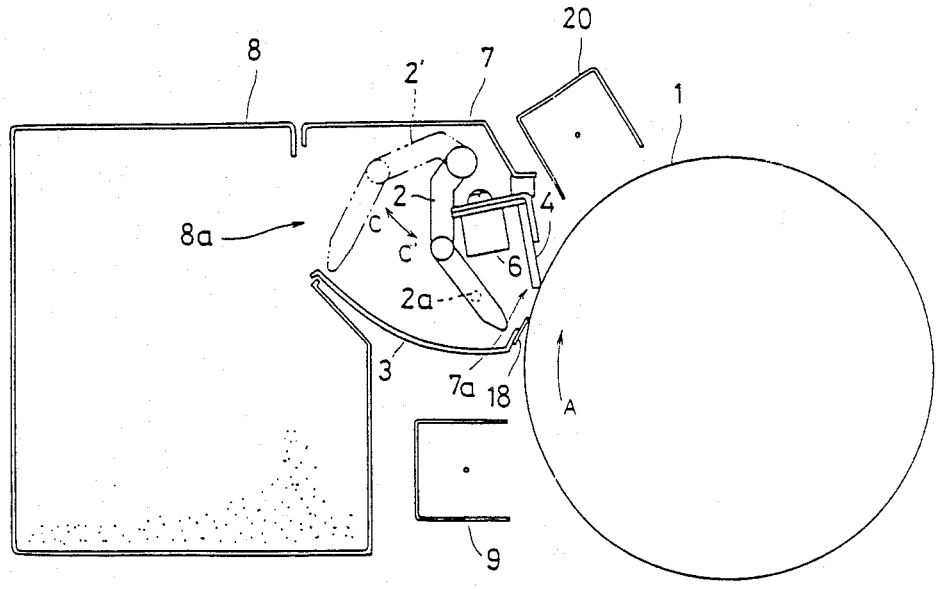
FIG. 1 is a sectional view representing the simplified structural design of a cleaner device for an electrophotographic copying machine embodied by the present invention.

Referring to the accompanying drawings, the preferred embodiments of the present invention are described below. FIG. 1 is the simplified structural diagram of the cleaner unit for the electrophotographic copying machine reflecting the preferred embodiments of the present invention.

Cleaner unit 7 is installed between discharge-charger 9 and charger 20 so that it faces photoreceptive drum 1. Container 8 is located in a position opposite photoreceptor 1 of cleaner unit 7. The upper surface of container 8 lies flush with the upper surface of cleaner unit 7, whereas the bottom surface of container 8 is at the lowest position possible without interfering with the copy-paper path (not shown). Blade 4 is attached to the upper portion of aperture *7a* on the photo-receptor part of the cleaner unit 7 with metal brace 6. The tip of blade 4, made of elastic material, comes in contact with the surface of photoreceptive drum 1. This allows blade 4 to slide over the surface of the photoreceptor when the photoreceptive drum 1 moves in the direction of arrow A (while the photocopying operation is underway) so that residual toner adhering to the surface can be scraped clean. The dislodged toner is contained solely on surface 3 of cleaner unit 7 by means of shield 18 attached to the photoreceptor side of the bottom surface of cleaner unit 7. Cleaner unit 7 includes conveying member 2, which pivots in the following manner: conveying member 2, is put into motion by the conveying member driving mechanism described below and it returns to its starting position in the direction of arrow C or arrow C' between the positions shown by solid line and broken line 2'.

Figure 2:
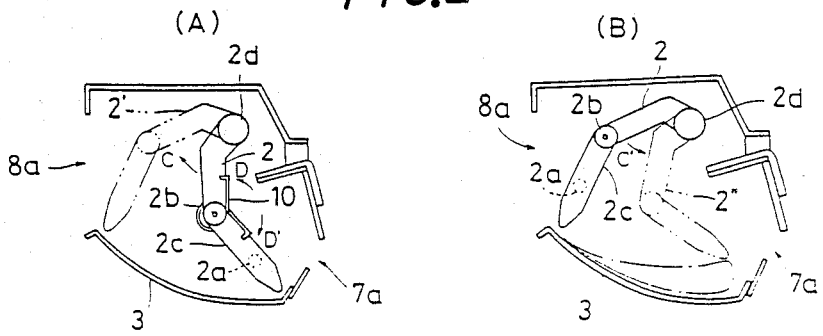
FIGS. 2A-and-B are operation diagrams of a conveyer member used for the preferred embodiment of the present invention.
Figure 3:
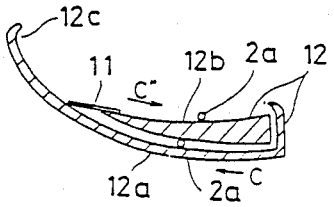
FIG. 3 is a diagrammatical cross-sectional view along line 3—3 of FIG. 5 of the guide plate used for the preferred embodiment of the present invention.

FIGS. 2 (A) and (B) are the operation diagrams of the conveyer mechanism inside the cleaner unit of the electrophotographic copying machine described above. The top end of conveyer member 2 is designed to move in conjunction with member *2c* via pivot *2b*. Both conveyer member 2 and member *2c* are returned in the arrowed directions D and D', respectively, by means of return spring 10 attached to pivot *2b*. Projection *2a* on the lateral surface of member *2c* controls movement of the tip portion of member *2c* by coming into contact with guide plate 12 (described below). Referring to FIG. 2 (A), when the conveyer member 2 moves from aperture *7a* in the direction of arrow C to position 2' (broken line) near container aperture *8a*, the tip of member *2c* comes into contact with surface 3 to move stored residual toner through aperture *8a* of the container. Referring to FIG. 2 (B), when conveyer member 2 moves in the direction of arrow C' from aperture *8a* of the container to aperture *7a* of the photoreceptor, the tip of member *2c* does not come in contact with surface 3 of cleaner unit 7, but remains in position 2'' (broken line of the drawing.) As a result, due to the spring return movement 10 of conveyer member 2, the tip of member *2c* moves along the broken-line track shown in FIG. 2 (B). FIG. 3 is a sectional view of guide plate 12 of cleaner unit 7 of said electrophotographic copying machine. Guide plate 12 is composed of members *12a* and *12b* which are positioned to form a curve corresponding to surface 3 of cleaner unit 7. Elastic member 11 is positioned at the end of the path between member *12a* and member *12b*. When projection *2a* of conveyer member 2 moves in the direction of arrow C, between members *12a* and *12b* of guide plate 12, it stretches elastic material 11 until member 2 reaches a position very close to area 12C of guide plate 12. Projection *2a* then passes between elastic material 11 and member *12a*, and returns in direction C'' along the upper surface of member *12b*. Thus guide plate 12 provides flexible foward and backward movement of conveyer member 2. Using the elastic force of return spring 10, projection *2a* maintains its position between members *12a* and *12b* in direction C, and against member *12b* in direction C''.

Figure 4:
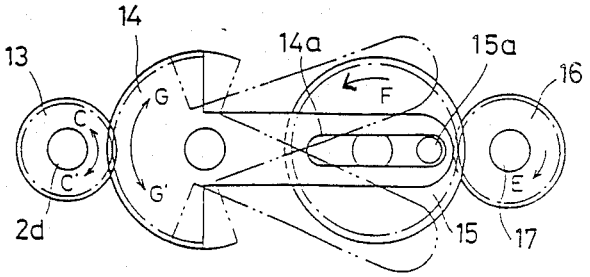
FIG. 4 is a schematic view of a drive force transmission mechanism embodied by the present invention.

FIG. 4 is a structural diagram of the drive force transmission mechanism used for cleaner unit 7 of the electrophotographic copying machine. Drive gear 16 is connected to drive shaft 17. Momentum is transmitted to gear 15 when it is engaged with drive gear 16. Projection *15a*, on the lateral surface of transmission gear 15, meshes with guide groove *14a* of reciprocating gear 14. Transmission gear 13 engaged with the reciprocating gear 14 is secured to shaft *2d* of conveyer member 2. When drive shaft 17 rotates in the arrowed direction E, transmission gear 15 rotates in the arrowed direction F. Simultaneously, since the projection *15a* and the guide groove *14a* are engaged with each other, reciprocating gear 14 moves back and forth between the directions of arrows G and G'. The reciprocating drive force is then transmitted to shaft *2d* of conveyer member 2 via transmission gear 13.

Figure 5:
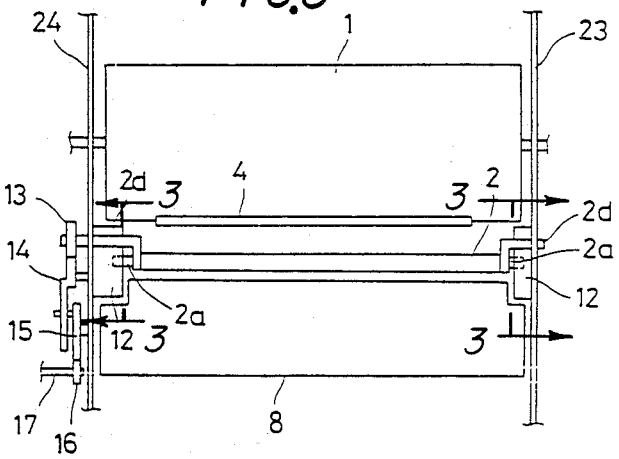
FIG. 5 is a plan view representing the simplfied design of the cleaner embodied by the present invention.

FIG. 5 is the plan view representing the simplified structure of the cleaner of the electrophotographic copying machine.

A pair of guide plates 12 are installed facing each other inside frames 23 and 24 of the electrophotographic copying machine to support photoreceptive drum 1 via a shaft. Projection *2a* of the conveying member 2 rests on guide plate 12. Shafts 2d of conveyer member 2 are both supported by the cleaner unit (not shown in FIG. 5.) The shaft of frame 24 is provided with this drive force transmission mechanism.

Actual operations of the preferred embodiment are described below. The part of the surface of photoreceptive drum 1 which just completed the discharge process during the photocopying operation comes into contact with the tip end of blade 4 of the cleaner, which scrapes residual toner from the surface. Scraped toner falls to surface 3 of cleaner unit 7 through aperture *7a* of photoreceptive drum 1. At the same time, rotation of the drive shaft 17 receiving momentum from the main motor (not shown in the accompanying drawings) is converted into reciprocating movement, which is then transmitted to shaft *2d* of conveyer member 2. This transission of momentum permits conveying member 2 to execute the reciprocating movement in the directions of arrows C and C'. As a result of the engagement of projection *2a* with the lateral surface of member *2c* at guide plate 12, the tip of member *2c* comes into contact with surface 3 of cleaner unit 7 when conveyer member 2 moves in the direction of aperture *8a*. This action pushes stored toner in the direction of aperture *8a* of the collection container and into the container itself. Because of return spring 10, when conveying member 2 moves in the direction of the aperture of the photoreceptor (*7a*), the tip of member *2c* does not touch surface 3 of cleaner unit 7. Toner scraped from the surface of photoreceptive drum 1 by blade 4 is never pushed in the direction of aperture *7a* of the photoreceptor. By this method its is possible for the system to convey the scraped toner to aperture *8a*, even through the aperture is located slightly above surface 3. The installation of a container of sufficient capacity in a position opposite the photoreceptor of the cleaner unit not only simplifies repair and maintenance procedures but also enables an increase in the storage capacity of the residual toner collection container.

As is clear from the above description, the preferred embodiment of the present invention makes it possible for an electrophotographic copying machine to utilize a residual toner collection container of sufficient size to dispense with the need to move or remove the container when performing routine repair or maintenance services. The useful design also prevents the container from becoming full of scraped toner prior to regularly scheduled maintenance service. Consequently, users can be freed from the complicated and inconvenient task of replacing the stained container, a significant improvement in service for the consumer.

While only certain embodiments of the present invention have been described, it will be apparent to those skilled in the art that various changes and modifications may be made therein without departing from the spirit and scope of the present invention as claimed.

What is claimed is:

1. A cleaner for an electrophotographic copying machine comprising:

a blade in contact with the surface of a photoreceptive drum;

a cleaner unit; and a container for storing toner stripped from the surface of said photoreceptive drum by the blade;

an aperture in said container provided in a position above a bottom surface of said cleaner unit, a reciprocable conveyor member provided inside said cleaner unit, said conveyor member having a cleaning tip for reciprocating between the aperture of said container and said photoreceptive drum, and guide means for causing said conveyor member to move said tip into contact with the bottom surface of said cleaner unit when said conveyor member moves in the direction of the aperture of said container, and conversely, for preventing said tip of said conveyor member from contacting the bottom surface of said cleaner unit when said conveyor member moves in the direction of said photoreceptive drum.

2. A cleaner for an electrophotographic copying machine, comprising:

a cleaner unit for removing residual toner from the surface of a photosensitive drum and for transporting the residual toner to a receiving container;

said cleaner unit including, a blade in contact with the surface of the photosensitive drum for scraping the residual toner therefrom, a shield attached to the photoreceptor side of the bottom surface of said cleaner unit adjacent the photosensitive drum for directing the residual toner to said bottom surface, an aperture provided in said cleaner unit, said aperture being positioned above said bottom surface of the cleaner unit and directly confronting an aperture in said receiving container, a reciprocable conveyor member provided inside said cleaner unit, said conveyor member having a cleaning tip for removing the residual toner from the bottom surface of the cleaner unit into said receiving container, and guide means for causing said conveyor member to move said cleaning tip into contact with the bottom surface of said cleaner unit when said conveyor member moves in a first direction toward said aperture in said receiving container, and conversely for preventing said cleaning tip from contacting the bottom surface of said cleaner unit when said conveyor member moves in a second direction toward said photoreceptive drum.

3. A cleaner according to claim 2, wherein said reciprocable conveyor member includes first and second pivotally connected levers connected by a return spring at a pivot point therebetween, said second lever terminating in said cleaning tip whereby said return spring aids in forcing said cleaning tip into contact with the bottom surface of said cleaning unit in the first direction and aids in preventing said cleaning tip from contacting the bottom surface of said cleaning unit in the second direction.

4. A cleaner according to claim 3, further including projection members operatively connected to lateral ends of said second lever adjacent said cleaning tip, whereby said projection members follow a guide path formed by said guide means for causing said cleaning tip to contact the bottom surface of said cleaner unit in the first direction and for preventing said cleaning tip from contacting the bottom surface of said cleaner unit in the second direction.

5. A cleaner unit according to claim 4, wherein said guide means includes a first guide slot formed by a first guide plate having a shape corresponding to the bottom surface of said cleaner unit and a second guide plate positioned above said first guide plate, a second guide slot having a shape corresponding to the upper surface of said second guide plate, and an elastic member positioned at a terminal end of said first guide slot and in surface contact with both of said first and second guide plates, said first and second guide slots and said elastic member combining to form said guide path, whereby said projection members move in said first guide slot when said cleaning tip is moving in the first direction and are prevented from re-entering said first guide slot by said elastic member, such that said projection members move in said second guide slot when said cleaning tip is moving in the second direction.

* * * * *